US005518414A

United States Patent [19]

Antonini et al.

[11] Patent Number: 5,518,414

[45] Date of Patent: May 21, 1996

[54] ELECTRICAL CONNECTOR WITH FLOATING V-SPRING CONTINUITY BRIDGE

[75] Inventors: Gino Antonini, Pelham; David I. Weinstein, Yorktown Hts., both of N.Y.

[73] Assignee: Kings Electronics Co., Inc., Tuckahoe, N.Y.

[21] Appl. No.: 267,157

[22] Filed: Jun. 28, 1994

[51] Int. Cl.[6] ..... H01R 29/00

[52] U.S. Cl. ..... 439/188; 200/51.1

[58] Field of Search ..... 439/188, 944; 200/51.1

[56] References Cited

U.S. PATENT DOCUMENTS

| | | | |
|---|---|---|---|
| 4,894,019 | 1/1990 | Howard | 439/188 OR |
| 5,071,362 | 12/1991 | Martens et al. | 200/51.1 X |
| 5,147,992 | 9/1992 | Eriksen et al. | 200/51.1 OR |
| 5,164,880 | 11/1992 | Cronin | 200/51.1 X |
| 5,246,378 | 9/1993 | Seiceanu | 439/188 OR |

*Primary Examiner*—P. Austin Bradley
*Assistant Examiner*—Daniel Wittels
*Attorney, Agent, or Firm*—Bierman and Muserlian

[57] ABSTRACT

A connector assembly containing a V-shaped spring continuity bridge, which moves between a first position, in which continuity is maintained between two contacts, and a second position in which continuity between the two contacts is broken, upon insertion of a mating plug, the V-spring continuity bridge being mounted to the connector body via a mounting block. The V-shaped spring is formed so that a center portion thereof is radiused, and no sharp angles are present. This center portion loosely fits into a corresponding groove formed in the mounting block allowing for movement of the entire V-spring continuity bridge upon deflection caused by contact with the mating plug.

9 Claims, 3 Drawing Sheets

ELECTRICAL CONNECTOR WITH FLOATING V-SPRING CONTINUITY BRIDGE

The present invention is directed to an electrical connector assembly including a pair of connectors having a continuity bridge positioned therebetween, and more specifically, to a connector in which the continuity bridge is formed of a V-spring non-bindingly held in position between the connectors, within a mounting block. The invention is further directed to a connector assembly in which the V-spring continuity bridge can be attached to the connector, without screws.

BACKGROUND OF THE INVENTION

Connectors of the type to which the invention is directed are generally well known in the art and are described, for example, in U.S. Pat. No. 5,280,254. Such connectors are formed with two contacts, and are adapted to receive a mating plug, which includes mating contacts, corresponding to those of the connector. These connectors further include a continuity bridge, the purpose of which is to maintain electrical continuity between the first and second contacts of the connector, when the mating plug is withdrawn. Upon insertion of the mating plug, the first or second contacts are placed in electrical continuity with the corresponding mating contact of the plug. Upon further insertion of the mating plug, the armature of the continuity bridge is moved out of connection with the first or second contact.

Continuity bridges of the type used in these connectors were generally V-shaped springs, having a central flat portion which was rigidly attached to the connector. The base connected two actuating armatures, each of which contacted one of the first and second contact of the connector. A sharp angle was formed between these actuating armatures, and the center portion of the continuity bridge. This central flat portion was rigidly attached to the connector by either using screws or molding the flat portion rigidly into a plastic base. With connectors of this type it was found that, when the armatures of the V-spring were deflected by the mating plug, causing the legs to bend, they did so at the point that the leg was either embedded directly into a molded plastic base, or at the bend between the actuating armature and the center portion of the bridge. This construction caused all stresses to be focused at one particular point on the spring, resulting in a limited life cycle of approximately 15,000 insertions and removals. In addition, it was found that contact pressure between the actuating armatures of the V-spring, and the connector contacts, dropped significantly over time and use.

BRIEF DESCRIPTION OF THE INVENTION

In view of the foregoing, it is an object of the present invention to provide a connector assembly including a V-spring continuity bridge which displays an improved function and durability.

It is another object of the invention to provide a connector in which the continuity bridge can be easily attached and assembled, without the use of screws.

Other objects and features of the present invention will become apparent from the following detailed description considered in conjunction with the accompanying drawings.

DETAILED DESCRIPTION OF THE INVENTION

Figure 1:
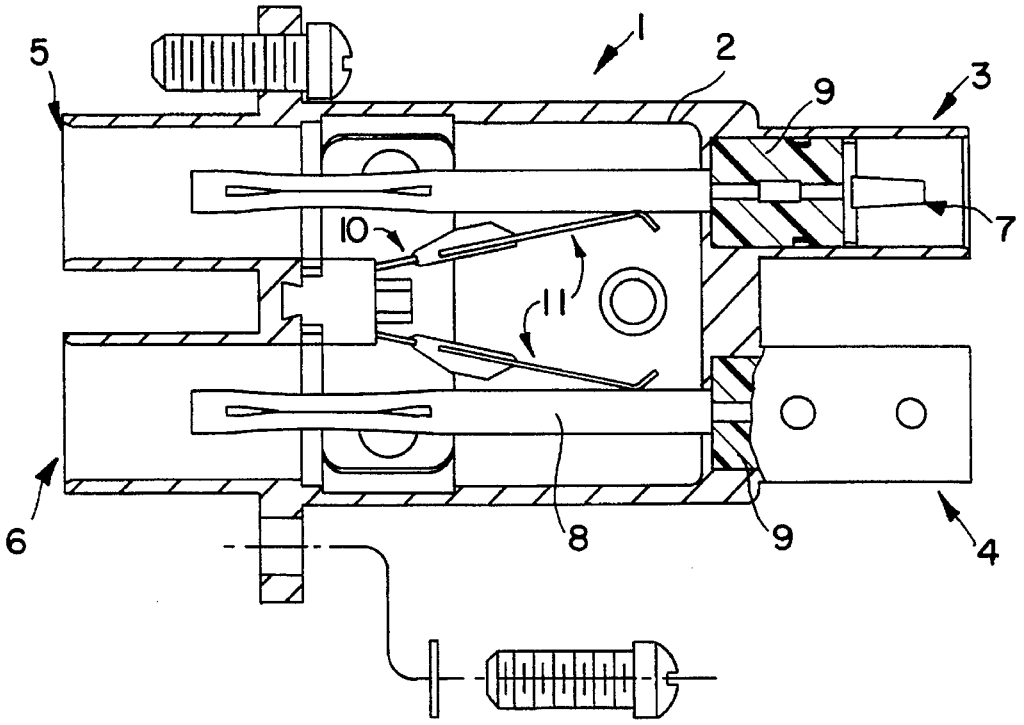
FIG. 1 is a sectioned side view of the inventive electrical connector.

Referring to FIG. 1, there is shown one embodiment of the inventive connector. Connector assembly 1 comprises hollow connector body 2 formed of a conductive material. Supplied at one end of connector body 2 are first and second ports 3, 4; on the opposite side of connector body 2, there corresponding third and fourth ports 5, 6, adapted to accept a mating plug (not shown) are provided. Mounted concentrically within first port 3 is first connector contact 7; similarly, second connector contact 8 is concentrically mounted within second port 4. These connector contacts are held within the ports by insulative blocks 9, and extend parallel to each other from the first and second ports, toward the corresponding third and fourth ports of the connector body.

Figure 2:
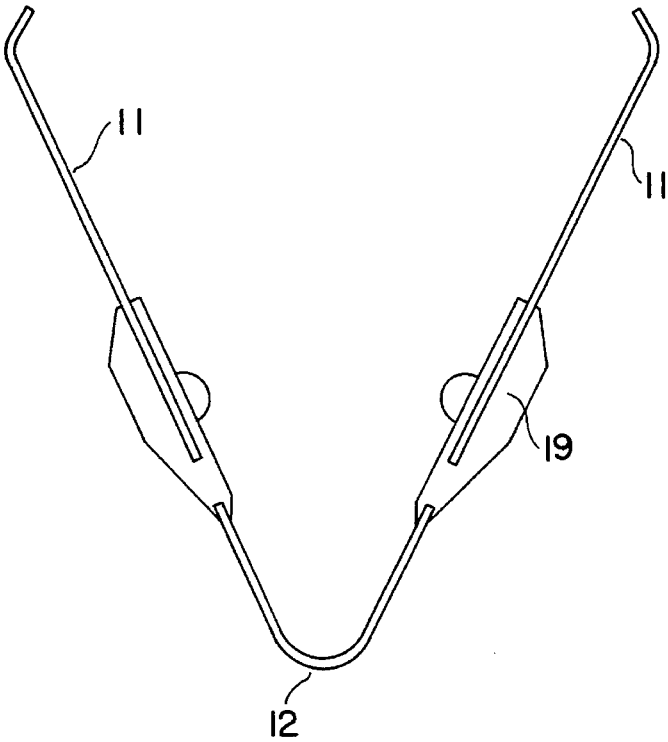
FIG. 2 illustrates the V-spring continuity bridge of the invention.
Figure 3:
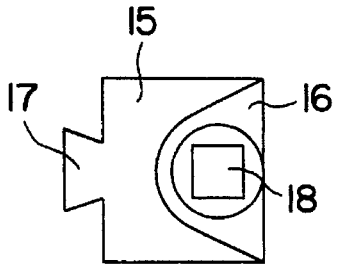
FIG. 3 shows a top view of the bottom half of the inventive mounting block.
Figure 4:
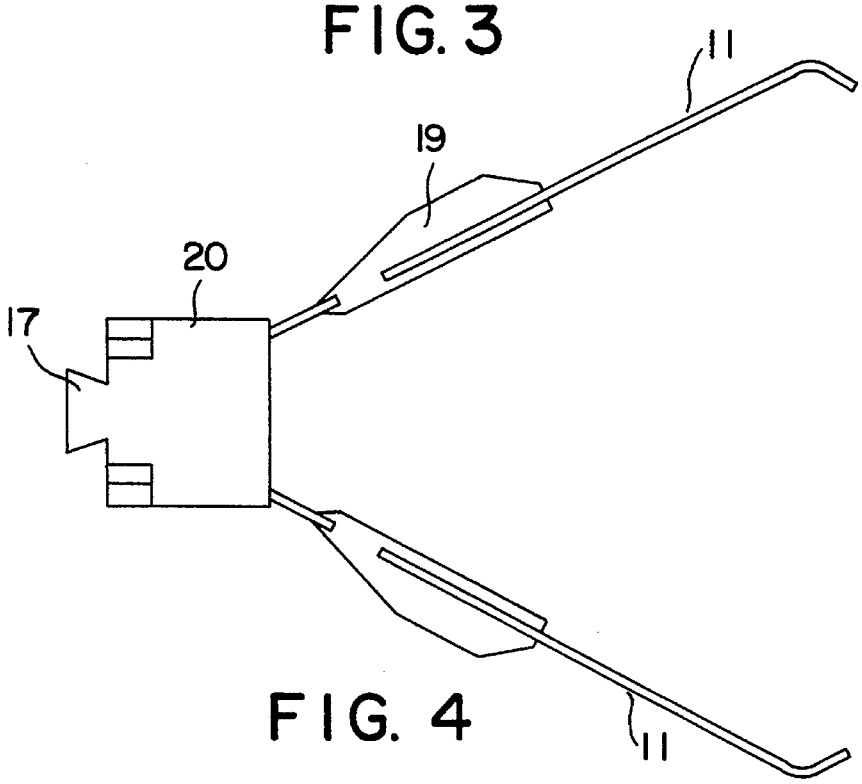
FIG. 4 illustrates the inventive continuity bridge mounted in the mounting block with top and bottom halves joined.

Mounted opposite first and second ports 3, 4 in connector body 2, positioned between third and fourth ports 5, 6 is a "V"-shaped spring 10 which operates as a continuity bridge. V-shaped spring 10 includes actuator armatures 11 connected by central portion 12 (see FIG. 2). Flexible actuator armatures 11 of spring 10 are movable between a first and second position, actuator armatures 11 being in this first position, contacting each of first connector contact 7 and second connector contact 8, and establishing an electrically conductive bridge therebetween, when no mating plug is mated to connector body 2. Upon insertion of a mating plug into third or fourth ports 5, 6, actuating arms 11 are moved to a second position, in which continuity between first connector contact 7 and second connector contact 8 is interrupted.

Figure 5A:
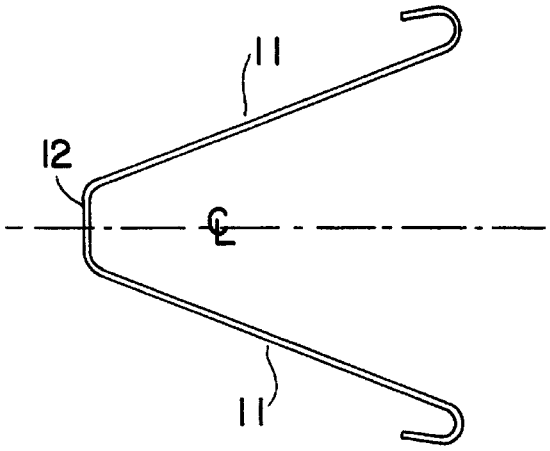
FIG. 5A PRIOR ART
FIGS. 5A and 5B show two embodiments of the prior art continuity bridges.
Figure 5B:
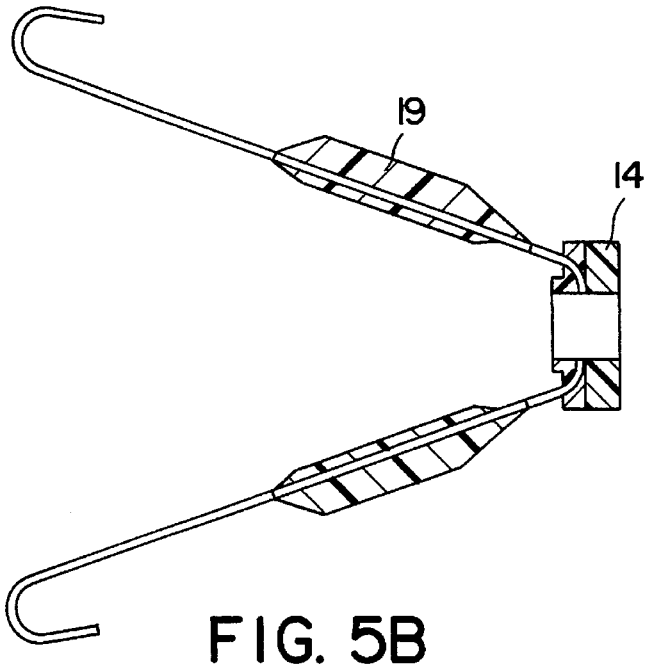
FIG. 5B PRIOR ART
Figure 5C:
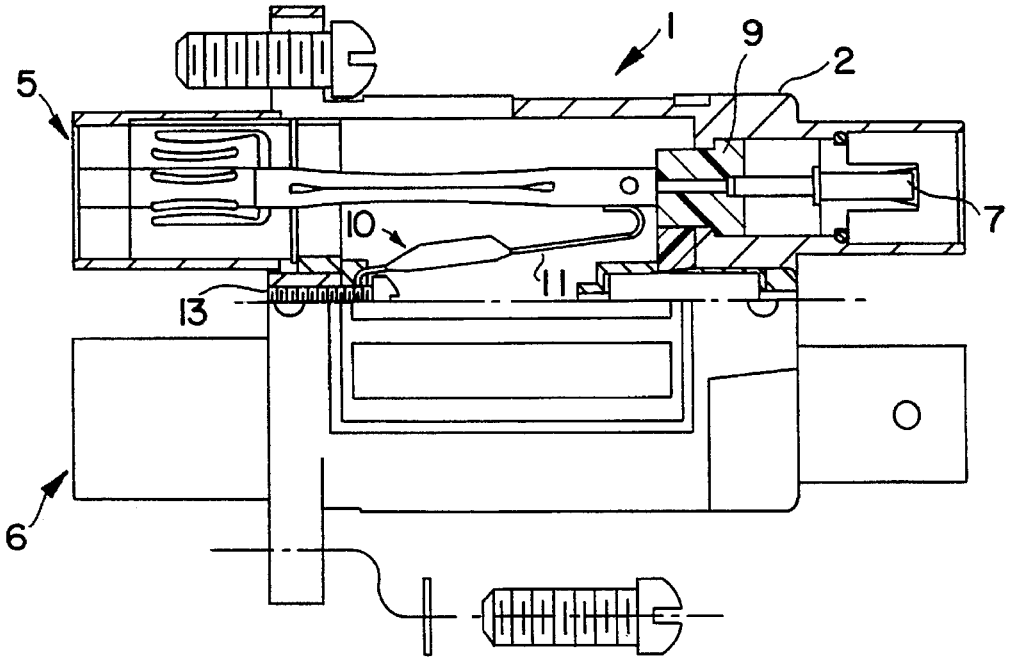
FIG. 5C PRIOR ART
FIG. 5C illustrates the prior art continuity bridge, as mounted in an inventive-type connector.

In connectors of the prior art, continuity bridges were commonly formed as shown in FIG. 5*a*. The springs thereof include actuator arms which operate in the same manner of the invention; however, the transition of the actuator arm to the central portion is formed with a large angle. The central portion, as shown in FIG. 5B, was molded rigidly in insulator 14, which was in turn, screwed directly to the connector body. In the prior art case, the V-shaped spring was held rigidly in position, with no movement possible between the spring, and the connector body.

Because of the rigidity of the prior art manner of mounting the V-shaped spring continuity bridge, stresses generated by action of the mating plug on the actuating armatures focused at the point at which the actuator armatures joined the central portion. Because of this, the life cycle of the prior art continuity bridge was only about 15,000 flexes.

In order to address the limited life cycle of the prior art continuity bridge, the bridge of the invention has a central portion formed as a radius, and a V-shaped spring is mounted to connector body 2 by way of mounting block bottom 15. Mounting block bottom 15 has formed therein radiused groove 16 into which V-shaped spring 10 is mounted. Groove 16 is slightly wider and deeper than the thickness and height of V-shaped spring 10 to allow movement, or float. Thus, block 15 captivates spring 10 within radiused groove 16 with actuating armatures 11 exposed, while allowing spring 10 non-binding movement.

Preferably, mounting block 15 has dovetail 17 by which mounting block 15 is mounted, via a corresponding dovetail recess, to connector body 2. Dovetail 17 allows mounting of mounting block 15 to connector body 2, without the use of screws. The use of a screw would be problematic with the V-shaped spring of the invention, as passage of such a screw through the spring would inhibit the non-binding movement, which is essential to the invention.

In assembling V-shaped spring 10 to mounting block 15, spring 10 is placed into radiused groove 16, and an insulating V-spring block cover 20 with a slotted square shaft and shoulder, is pressed into mounting block 15 until the shoulder on the shaft passes through square hole 18 in mounting block 15, thereby captivating spring 10 within groove 16. Dovetail 17 can then be press fit into the corresponding dovetail recess of the connector body, to complete the assembly of the connector.

The ability of spring 10 to float within mounting block 15 allows the stress of the deflection caused by interaction of the mating plug and actuator armatures 11 to be distributed around the radius of spring 10, greatly extending the life cycle of the continuity bridge. The life cycle of the inventive continuity bridge is well over 100,000 flexes. In addition, with the V-shaped spring continuity bridge of the invention, pressure remains constant over the lifetime thereof, in contrast to earlier designs, which were found to display significant drops in contact pressure after continuous use. Both the radiused design of the central portion 12 of the V-shaped spring 10 to which the invention is directed, as well as the ability of this spring to move within mounting block 15 upon deflection of actuator arms 11 contribute to the extended life of the inventive connector.

Spring 10 of the invention is preferably formed of beryllium copper that is heat treated and then plated. Further, it is preferable that actuating cam 19 be molded onto each actuator arm, to insulate actuator arm 11, from contact with the mating plug. Mounting block 15 can be formed of either an insulating, or conductive material, allowing the same configuration of connector to be used in several different connector applications.

While only the fundamental novel features of the invention as applied to a preferred embodiment thereof have been shown and described, it is understood that various omissions, substitutions, and changes in the form and details in the device illustrated and in its operation may be made by those skilled in the art without departing from the spirit of the invention. It is therefore the intention of Applicants that the invention be limited only as indicated by the scope of the claims appended hereto.

We claim:

1. A connector assembly comprising:

a connector body having provided on a first side thereof, first and second ports, and on an opposite side thereof, third and fourth ports, said third and fourth ports being adapted to accept a mating plug;

first and second connector contacts, mounted concentrically within each of said first and second ports, said contacts extending parallel to each other from said first and second ports toward said third and fourth ports;

a V-shaped spring contact, a center portion of which is mounted on said connector body opposite said first and second ports between said third and fourth ports, flexible armatures of said spring being movable between a first and second position; said armatures being in said first position, contacting each of said first and second contacts, and establishing an electrically conductive bridge therebetween in the absence of said mating plug; insertion of said mating plug into said third or fourth ports moving said armatures to said second position, in which continuity between said first and second connector contacts is interrupted, said V-spring contact being mounted on said connector through a mounting block, said V-shaped spring being held within a groove formed in said mounting block, an inside width and depth of said groove being greater than a thickness and height of said V-shaped spring, whereby said V-spring is maintained in position by said mounting block and is concurrently capable of non-binding movement therewithin.

2. The connector assembly of claim 1 wherein said center portion of said V-shaped spring is radiused whereby no sharp angles are formed between said arms and said center portion.

3. The connector assembly of claim 1 wherein said mounting block further comprises a dovetail, adapted to fit into a corresponding recess formed on said connector body, wherein said mounting block, via said dovetail can be press fitted to said connector body.

4. The connector assembly of claim 3 wherein said mounting block is formed of a conductive material.

5. The connector assembly of claim 3 wherein said mounting block is formed of an insulative material.

6. The connector assembly of claim 1 wherein said V-shaped spring contact is formed of heat treated beryllium copper then plated.

7. The connector assembly of claim 6 wherein actuating cams are molded onto each armature of said V-shaped spring contact.

8. The connector assembly of claim 2 wherein said V-shaped contact spring is plated, heat treated beryllium copper.

9. The connector assembly of claim 8 wherein actuating cams are on each armature of said V-shaped contact spring.

* * * * *